United States Patent [19]

Davis, Jr. et al.

[11] Patent Number: 4,491,494

[45] Date of Patent: Jan. 1, 1985

[54] DECORATING METHODS

[75] Inventors: Thomas H. Davis, Jr., Leavenworth; Stephen D. Glasscock, Overland Park, both of Kans.

[73] Assignee: Hallmark Cards, Inc., Kansas City, Mo.

[21] Appl. No.: 499,721

[22] Filed: May 31, 1983

[51] Int. Cl.[3] ..... B44C 1/16

[52] U.S. Cl. ..... 156/240; 156/86; 156/241

[58] Field of Search ..... 156/86, 240, 241; 8/471; 427/152; 428/913

[56] References Cited

U.S. PATENT DOCUMENTS 3,647,503 3/1972 Mizutani et al. ..... 427/152 X

FOREIGN PATENT DOCUMENTS 2101530A 1/1983 United Kingdom ..... 156/241

*Primary Examiner*—Evan K. Lawrence

*Attorney, Agent, or Firm*—Neuman, Williams, Anderson & Olson

[57] ABSTRACT

An article is decorated by applying a coating to the surface of the article to be decorated, placing over and around the coated article a shrinkable film carrying a desired decoration, shrinking the film over the coated article to transfer the decoration to the article and then removing the shrinkable film leaving on the surface of the article the desired decoration or ornamentation.

10 Claims, 5 Drawing Figures

FIG. 1
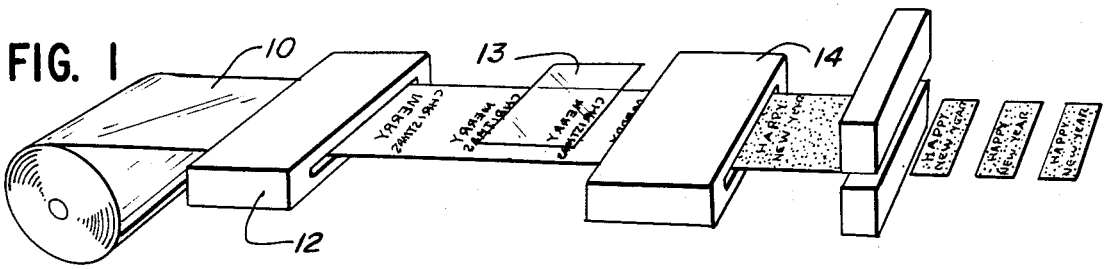
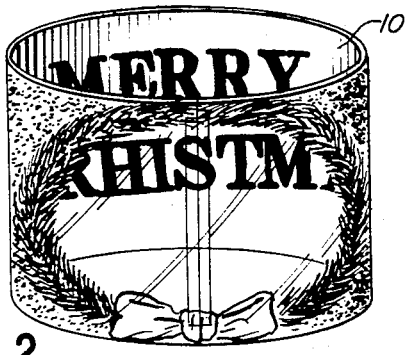
FIG. 2
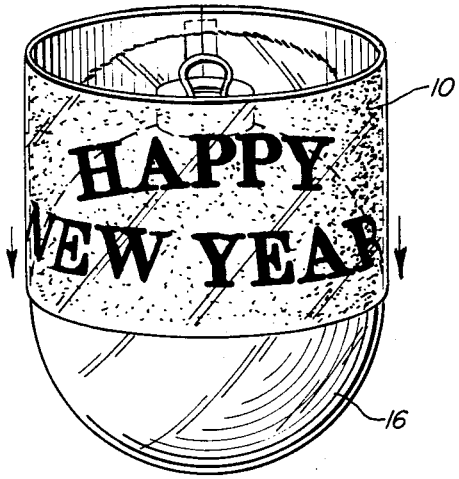
FIG. 3
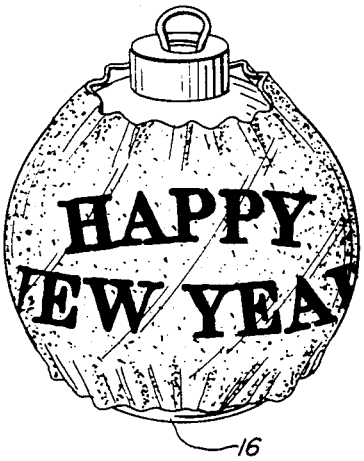
FIG. 4
FIG. 5
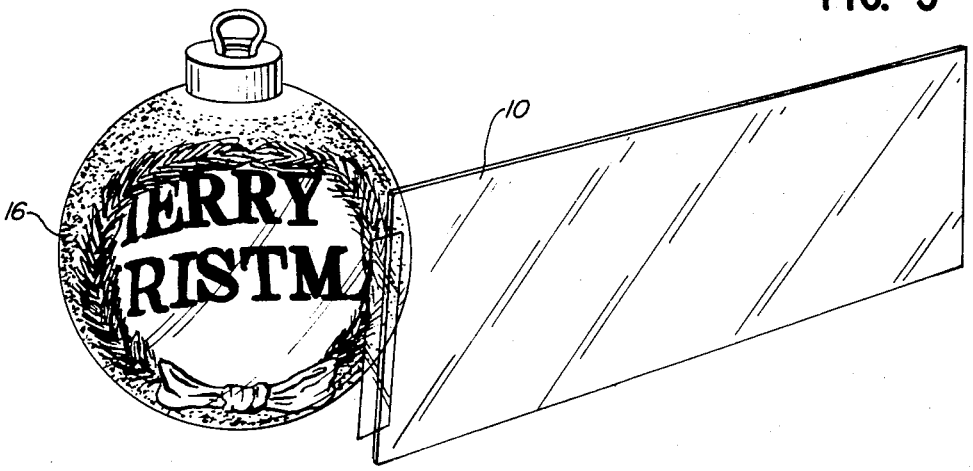

DECORATING METHODS

This invention relates to methods of providing ornamentation on objects.

BACKGROUND OF THE INVENTION

Various articles are decorated by placing a decorative band of a shrinkable material around the article and then heating the band to cause it to shrink to conform to the surface of the article. Spherical, cylindrical and irregular shaped three-dimensional articles can be decoratively ornamented in this manner. A few examples of such articles which can be decorated in this manner are fragile toys, glass articles, craft models and seasonal ornaments such as Christmas tree bulbs. This decorating technique possesses considerable advantages over prior techniques which involve decorating the articles by hand or by using silk screen or striping machinery. However, with the use of this technique the finished decorated articles have secured thereto a band or film of a shrinkable material. For certain applications it is desirable to produce decorated articles which do not have secured thereto an overlay of a shrinkable material.

SUMMARY AND OBJECTS OF THE INVENTION

It is a principal object of this invention to provide improved methods for decorating articles.

It is a further object of this invention to provide methods for decorating articles, which methods possess the numerous advantages of decorating by use of a shrinkable film material.

It is a still further object of this invention to provide methods for decorating articles utilizing a shrinkable film to apply the decoration but wherein the shrinkable film does not remain secured to the decorated article.

In accordance with this invention, an article is decorated by applying a coating to the surface of the article to be decorated, placing over and around the coated article a shrinkable film carrying a desired decoration, shrinking the film over the coated article to transfer the decoration to the article and then removing the shrinkable film leaving on the surface of the article the desired decoration or ornamentation.

BRIEF DESCRIPTION OF THE DRAWINGS

FIG. 1 is a flow diagram illustrating imprinting of a shrinkable material with a multi-layer design for use in accordance with the invention.

FIG. 2 is a schematic illustration showing a predecorated band of shrinkable material for use in accordance with the invention.

FIG. 3 is a schematic illustration showing a predecorated band of shrinkable material as it is being placed on an ornament.

FIG. 4 is an elevational view of a decorated ornament having a film of shrinkable material shrunk thereon.

FIG. 5 is an elevated view at 180 degrees of the decorated ornament of FIG. 4 with the film of shrinkable material being removed therefrom.

DESCRIPTION OF PREFERRED EMBODIMENTS OF THE INVENTION

One preferred embodiment of the invention will be described with reference to decorating a glass ball seasonal ornament as illustrative. As a first step, a base coating is applied to the outer surface of the ball to which the decoration is to be applied. The coating can be applied in any convenient manner, such as by spraying it on the target surface, and can be selected from coating materials which adhere to the surface of the ball and which accept an inked design. The base coating material is made from a film-forming resin, a plasticizer and a solvent. Representative film-forming materials are nitrocellulose, cellulose acetate propionate, cellulose acetate butyrate, ethyl cellulose, polyvinyl pyrrolidone, polyvinyl butyral, shellac and the like. One preferred base coating material is an R.S. nitrocellulose lacquer (Hercules R.S. 30–35 cps) with a viscosity grade of 30–35 centipoise containing about 1 to 2% by weight of dioctyl phthalate as a plasticizer. Other plasticizing agents, such as dibutyl phthalate, triethyl citrate, raw castor oil, blown castor oil, tributyl phosphate and sebacic acid alkyl resins, can also be employed. For ease of application, the nitrocellulose lacquer can be dissolved in an evaporative solvent to achieve a viscosity which permits it to be sprayed on the ball. A suitable evaporative solvent for this purpose is one composed of ethyl acetate 54% by weight, n-butyl acetate 27% by weight, isopropyl acetate 10% by weight, toluene 6% by weight and isopropyl alcohol 3% by weight. In this solvent blend, ethyl acetate, n-butyl acetate and isopropyl acetate are active solvents, while toluene and isopropyl alcohol are diluents. Of course, if another film former is used different, appropriate solvents are employed. Other active solvents for nitrocellulose, such as methyl ethyl ketone, methyl acetate, n-propyl acetate, ethyl lactate, butyl "Cellosolve" acetate, methanol, etc. and other diluents for nitrocellulose, such as xylene, ethanol and butanol, can be employed.

After application of the ink receptive base coating to the surface of the glass balls, an appropriately sized film of a shrinkable material carrying a desired decorative inked pattern is positioned in appropriate alignment around the coated ball. For example, with a glass ball ornament having an outer diameter of about 3.25 inches, a band of shrinkable material having a width of approximately 3 inches and a length of about 10.8 inches is placed around the ball. The shrinkable band is seamed at the ends thereof. The shrinkable band can be of the type commonly used to provide ornamentation for fragile and difficult to decorate articles. Generally such shrinkable bands comprise relatively thin sheets or films (usually 3 mils thickness or less) of natural and synthetic polymers which, when heated, shrink around an object in both high and low profile regions and conform to the object. Various heat-shrinkable plastics are known and commercially available, including shrink-type films formed from polyolefins such as polyethylene, polypropylene and copolymers thereof, polystyrene, acrylics, polyvinyl chloride copolymers of vinyl chloride and vinyl acetate and the like.

The inner surface of the shrinkable decorating band carries a desired pattern formed of an ink/binder composition. The decorative inked pattern is imprinted on the inner surface of the shrinkable material which contacts the coated surface of the ball. The decorative inked pattern can be applied to the shrinkable film in conventional manner such as by flexography or gravure printing.

A preferred ink to employ is one containing a nonreactive polyamide resin having a softening range of from about 190° to 250° F., preferably 190°–210° F. Such inks are known and are commonly used in flexographic and gravure printing of plastic films. The ink or inks forming the design or decoration can be of any design or color so as to contrast with the ball and be visible thereon.

The binder which is employed to carry the ink is a thermoplastic binder which melts at a temperature of from about 190° to 250° F. Representative suitable thermoplastic binders for the inks are non-reactive polyamides, poly (amideimides), cellulose acetate butyrate, vinyl chloride-vinyl acetate copolymers such as Union Carbide's VYHH and the like.

Important considerations as to selection of an ink-/binder composition are that the ink must be printable on the shrinkable film material to present a well defined pattern and yet be releasable therefrom so as to be transferable to the coated surface of the ball. The ink/binder composition is preferably one that melts at a temperature approximately the same or slightly less than the temperature normally used to shrink the band around the article to be decorated. If the melting point of the ink/binder composition is excessively high, the shrinkable band may tend to split or melt at the excessively high temperatures. On the other hand, the design may not be transferred to the article if a temperature substantially lower than the melting or softening temperature of the ink/binder is used to shrink the film. When using a shrinkable film which shrinks at a temperature of about 250° F., it is preferred to use an ink/binder composition which softens or melts at a temperature of about 230° to 250° F.

After positioning the design carrying shrinkable band around the ball in proper alignment, the band is subjected to heat so as to cause the band to shrink to a tight fit around the ball. Subjecting the printed shrinkable band to a temperature above that of the melting point of the ink binder causes the ink to be transferred to the coated surface of the ball upon melting of the ink binder. Generally, temperatures slightly above the melting point of the binder, such as temperatures on the order of about 260° F. to 320° F. are satisfactory. Heating can be accomplished by any suitable means, such as by passing the shrink wrapped ball through a conventional heat shrink tunnel for a short period to achieve the desired temperature. For example, the shrink wrapped ball can be passed through a five foot long convection heated shrink tunnel at a speed of about four feet per minute. This provides a residence time in the heat shrink tunnel of about 75 seconds. Under these conditions, the heat shrinkable band shrinks tightly around the glass ball and the high temperature melts the ink binder causing the ink print to come into intimate contact with the coating on the ball surface and to be transferred thereto.

Thereafter the ball is cooled to ambient temperature whereupon the heat-shrinkable band is stripped away leaving the printed image or pattern on the surface of the ball.

In accordance with one specific preferred embodiment, multiple designs are placed on a clear glass ball, for example. With this embodiment, a particular design can be applied to the surface of the ball and a different design can be overlayed thereon to permit viewing of the several designs. The multi-layered design or ornamentation can be applied to the ball simultaneously in a one-step procedure. Thus, as illustrative and referring to FIG. 1 of the drawings, a web 10 of a heat-shrinkable plastic film is passed through a process printing operation at 12 in which the strip is imprinted with a "Merry Christmas" greeting, say in three process colors (Print A). After this printing, an opaque white backing 13 is applied thereover and the film is then process printed at 14 with an additional greeting "Happy New Year" (Print B). Both of the imprinted greetings, Print A and Print B, are printed on the same side of the web and form a multi-layer decoration. The web is then cut into appropriately sized strips.

After being pre-decorated, a strip is formed into a band as shown in FIG. 2 and is then placed around an appropriately coated glass ornament 16 to be decorated as illustrated in FIG. 3. The glass ornament 16, with its pre-decorated shrinkable band 10 aligned thereon, is then heated to cause the band to shrink tightly around it and to cause the thermoplastic ink binder to melt with transfer of the inked greetings to the surface of the ball. Then, after cooling, the shrinkable plastic band 10 is stripped away from the ornament 16 leaving a multi-decorated ornament. On the outer surface of the glass ball the greeting "Happy New Year" is seen while in a 180° view through the glass ball the underlying greeting "Merry Christmas" is seen.

The present invention provides numerous advantages. The invention makes possible ornamentation of fragile articles and irregularly shaped articles which are difficult to decorate. The methods of the invention gain the advantages of decorating articles using pre-decorated shirnkable film materials without leaving such film materials attached to the decorated article. The decoration of articles can be easily accomplished using readily available materials and equipment to achieve a virtually unlimited variety of decorations, including full color print designs. Clear glass articles as well as opaque articles made of glass or other fragile materials can be readily decorated.

Those modifications and equivalents which fall within the spirit of the invention are to be considered a part thereof.

What is claimed is:

1. A process for decorating an article which comprises:

applying to said article a base coating adapted for receiving inked ornamentation, placing over and around the coated article a heat shrinkable plastic material carrying a decorative pattern formed from a thermoplastic ink, heating the shrinkable plastic material to a temperature sufficient to shrink the material and to cause it to conform to the surface of the article and to transfer the thermoplastic ink to the base coating on the article, and removing the shrinkable plastic material from the article leaving a decorated inked surface on the article.

2. A process in accordance with claim 1 wherein the heat shrinkable plastic material carries a plurality of decorative pattern layers separated by an opaque backing member whereby a multi-layered ornamentation is applied to the article.

3. A process in accordance with claim 1 wherein the thermoplastic ink has a melting point not above the melting point of the shrinkable material.

4. A process in accordance with claim 1 wherein the base coating has a melting point above the melting point of the thermoplastic ink.

5. A process in accordance with claim 1 wherein the article is generally spherical in shape.

6. A process in accordance with claim 1 wherein the surface of the article carrying the decoration is irregular.

7. A process in accordance with claim 1 wherein the article is an ornamental ball.

8. A process in accordance with claim 1 wherein the thermoplastic ink melts at a temperature of from about 190° to 250° F.

9. A process in accordance with claim 8 wherein the heat shrinkable material is one which shrinks at a temperature of about 250° F.

10. A process in accordance with claim 8 wherein the thermoplastic ink contains a polyamide resin having a melting point of from about 190° to 210° F.

* * * * *